United States Patent [19]

Kato

[11] Patent Number: 4,641,883

[45] Date of Patent: Feb. 10, 1987

[54] FOLDABLE SUPPORT

[75] Inventor: Teruyuki Kato, Funabashi, Japan

[73] Assignee: K.K. Iwai, Tokyo, Japan

[21] Appl. No.: 723,076

[22] Filed: Apr. 15, 1985

[51] Int. Cl.[4] ..... A47C 7/66; A47C 16/00

[52] U.S. Cl. ..... 297/184; 297/118; 297/391

[58] Field of Search ..... 297/56, 184, 188, 391, 297/397, 118; 5/432, 434; 248/169

[56] References Cited

U.S. PATENT DOCUMENTS

| | | | |
|---|---|---|---|
| 675,186 | 5/1901 | Bacon | 297/188 X |
| 1,033,108 | 7/1912 | Lehmann | 297/184 X |
| 2,574,590 | 11/1951 | Ross | 297/391 X |
| 4,063,318 | 12/1977 | Nicholson | 297/184 X |
| 4,544,203 | 10/1985 | Younger et al. | 248/118 X |

FOREIGN PATENT DOCUMENTS

| | | | |
|---|---|---|---|
| 290058 | 4/1969 | Australia | 297/184 |
| 1340890 | 9/1963 | France | 297/184 |

*Primary Examiner*—Francis K. Zugel
*Assistant Examiner*—Peter R. Brown

[57] ABSTRACT

A foldable headrest having first and second frames which are attached rotatably and crosswise to each other. A support element is rotatably attached to the frames in such a manner as to rotate on a common horizontal axis. A shade is provided on the support elements and belts and extend between upper ends and lower ends of the frame members.

7 Claims, 5 Drawing Figures

FOLDABLE SUPPORT

BACKGROUND OF THE INVENTION

This invention is concerned with a portable headrest used mainly in the open air such as at the beach.

Conventionally, for such a headrest, there was a vinyl article which when inflated with air took the form of a pillow. But this pillow had the function of only a pillow and was somewhat inconvenient when used in sun bathing at the beach or outdoors such as at times when the sunlight was dazzling or when tanning of the face was undesired.

This invention was developed in view of the foregoing situation, and it is intended to offer a headrest which is adapted for shielding the sunlight and designed to be foldable for convenience of carriage.

BRIEF DESCRIPTION OF THE DRAWING

The drawing shows an embodiment of the present utility model.

DETAILED DESCRIPTION OF THE INVENTION

Figure 1:
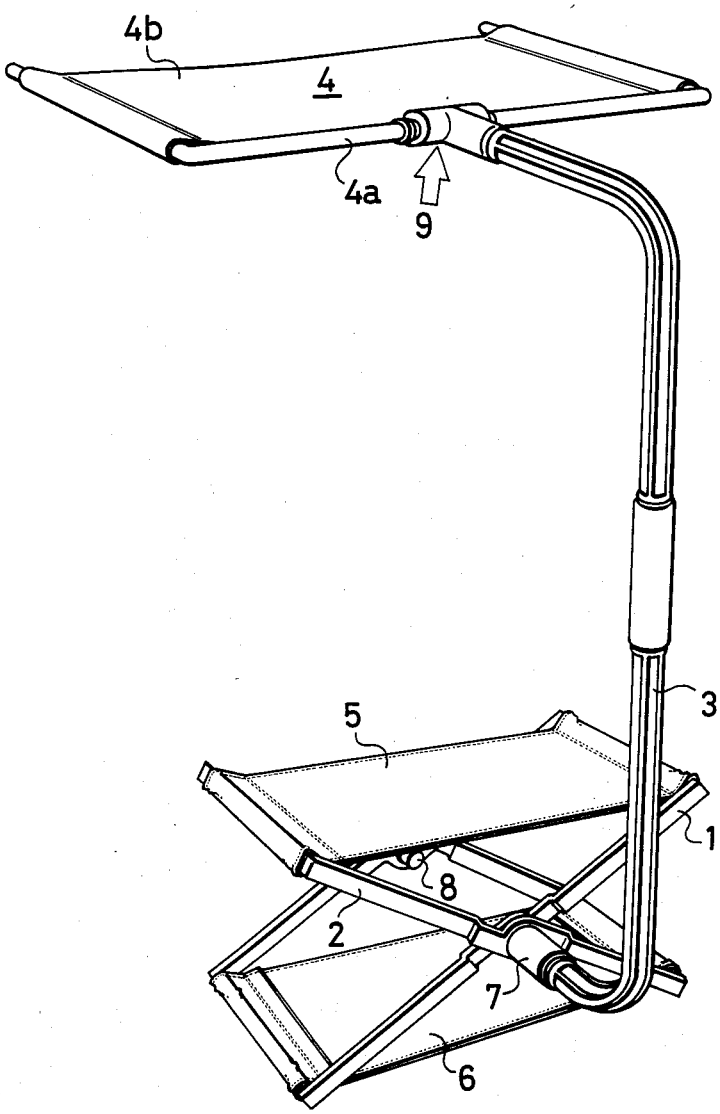
FIG. 1 shows an oblique view of the utility model.
Figure 3:
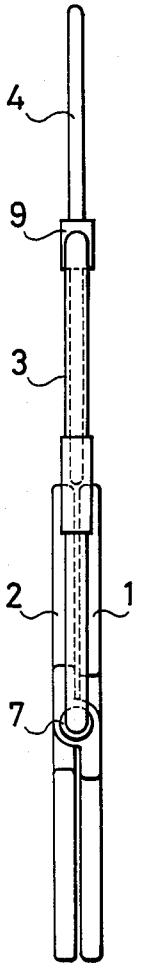
FIG. 3 shows the folded condition of the headrest.
Figure 2A:
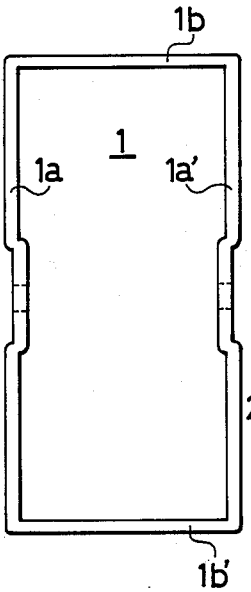
FIGS. 2(*a*) and (*b*) show plans of the frames constituting the headrest.
Figure 2B:
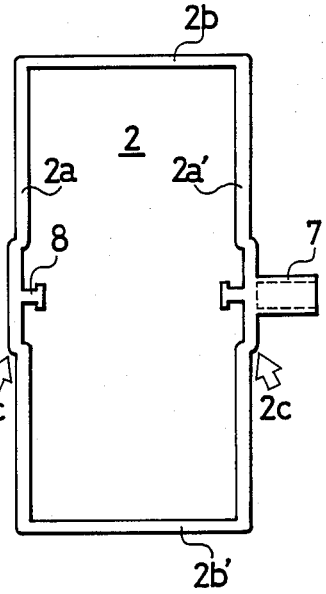
Figure 4:
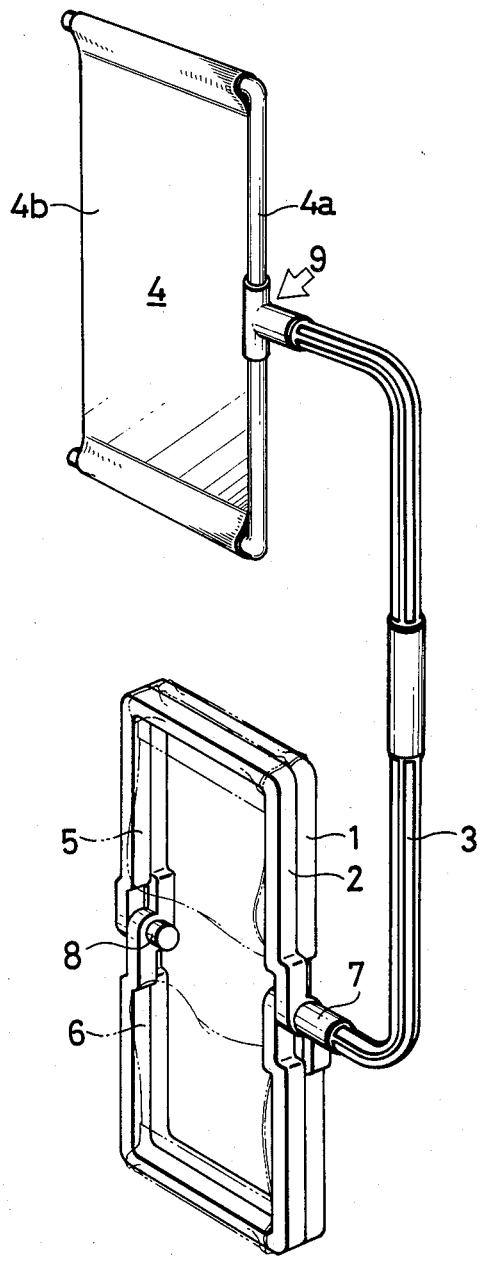
FIG. 4 shows the entire support structure in its folded position.

The headrest of the present invention will be described below. The headrest features in that a first frame (1) has a second frame (2) attached crosswise and rotatably and a supporting lever (3) provided at an appropriate place so as to revolve about a horizontal shaft, with a shade (4) provided on said supporting level and belts (5) and (6) extended between the upper ends and lower ends of said frames (1) and (2) respectively.

The present headrest will now be described with reference to an embodiment shown in the accompanying drawing.

Referring to the drawing, a first frame (1) in this embodiment comprises longitudinal frame members (1*a*) and (1*a*′) and lateral frame members (1*b*) and (1*b*′) and presents a rectangular form.

A second frame is attached to the first frame (1) crosswise and rotatably. The second frame (2) of the embodiment comprises longitudinal frame members (2*a*) and (2*a*′) and lateral frame members (2*b*) and (2*b*′) and presents a nearly rectangular form with a step (2*c*) provided in the longitudinal frame member (2*a*). This step (2*c*) engages the frame member (1*a*) when the frames (1) and (2) are unfolded so that the frames (1) and (2) are not unfolded beyond a predetermined angle relative to each other. The frames (1) and (2) of the embodiment are arranged crosswise respectively at the central part and are rotatable relative to each other about a long shaft (7) and short shaft (8).

A supporting lever (3) is provided at appropriate places of the frames (1) and (2) and rotates on a horizontal axis. The supporting lever (3) of the embodiment is provided rotatably on the frames (1) and (2) through a cylindrical holding means (7) fixed to frame (2).

A shade (4) is mounted on the supporting lever (3). The shade (4) of the embodiment is comprised of a belt (4*b*) spread on a rectangular frame (4*a*) and is attached to the upper end of the supporting lever (3) across a universal joint (9). The universal joint permits pivotable movement of the shade about perpendicular horizontal axes.

A belt (5) extends between the upper end of the first frame (1) and the upper end of the second frame (2).

A belt (6) extends between the lower end of the first frame (1) and the lower end of the second frame (2).

Being constructed as above, the headrest of the present invention has the following effects.

The foldable headrest of the present invention has a shade provided so that it is enabled to screen the sunlight and prevent the dazzle when sun bathing. The shade also serves for protecting the face from sunburn.

The foldable headrest of the present invention is folded into the form of a flat board and is, therefore, convenient for carriage and suitable for use in the open air.

Moreover, the shade (4) is attached to the supporting lever (3) across the universal joint (9) so that position thereof can be changed according to the position of the beam of sunlight. When the shade is erected vertically, the headrest is usable as a chair with the shade serving as a back.

What is claimed:

1. A foldable support comprising:

a first frame member having an upper and a lower end and a pair of inwardly projecting portions between such ends;

a second frame member having an upper and a lower end and a pair of outwardly projecting stepped portions between such ends, the first and second frame members being attached to each other so that each of the inwardly projecting stepped portions of the first frame member cooperates with one of the outwardly projecting stepped portions of the second frame member, the first and second frame members being rotatable relative to each other about an axis passing through the inwardly and outwardly projecting stepped portions;

a belt extending between the upper ends of the first and second frame members;

a supporting lever having two ends and rotatably mounted at one end to one of the frame members;

a third frame member fixed to the other end of the lever, the third frame member having a belt extending between said ends of said third frame member, whereby upon unfolding and erecting said support, said third frame member lies above said first and said second frame members; and a T-shaped joint member connecting the other end of the lever and the third frame member and having means to swivel the third frame about perpendicular horizontal axes.

2. A support as claimed in claim 1 wherein the first and second frame members are rectangular in shape, the projecting step portions are located substantially midway on the longer sides of the frame members, and the axis is at substantially the center point of such longer sides.

3. A support as claimed in claim 1 further comprising a pair of shaft members extending inwardly from the outwardly projecting stepped portions of the second frame member, the shaft members engaging in registering apertures in the inwardly projecting stepped portions of the first frame member to hold the first and second frame members securely to each other.

4. A support as claimed in claim 1 wherein the lever is mounted to the second frame member.

5. A support as claimed in claim 4 wherein the second frame member comprises a cylindrical holding means on one of the outwardly projecting stepped portions, the holding means being adapted to receive the one end of the supporting lever.

6. A support as claimed in claim 1 wherein the lever is a U-shaped tube, the one end of which is fixed to the second frame member and the other end of which is fixed to the third frame member.

7. A support as claimed in claim 1 wherein the third frame member is U-shaped and comprises two short sides joined by a long side, the long side being supported by the joint member, the belt extending between the two short ends.

* * * * *